US006299251B1

(12) United States Patent
Harper

(10) Patent No.: US 6,299,251 B1
(45) Date of Patent: Oct. 9, 2001

(54) FOLDABLE PARK BENCH

(76) Inventor: Sebert Harper, 78 E. 53rd St., Brooklyn, NY (US) 11203

( * ) Notice: Subject to any disclaimer, the term of this patent is extended or adjusted under 35 U.S.C. 154(b) by 0 days.

(21) Appl. No.: 09/628,639

(22) Filed: Jul. 31, 2000

(51) Int. Cl.[7] ..... A47C 4/00
(52) U.S. Cl. ..... 297/331; 297/335; 297/60
(58) Field of Search ..... 297/335, 331, 297/380, 232, 452.18, 378.12

(56) References Cited

U.S. PATENT DOCUMENTS

| | | | | |
|---|---|---|---|---|
| 139,389 | * | 5/1873 | Holzer et al. | 297/332 |
| 1,264,278 | * | 4/1918 | Cwiklinski | 297/59 |
| 3,194,601 | * | 7/1965 | Hoven et al. | 297/333 |
| 3,376,587 | | 4/1968 | Staron . | |
| 3,796,459 | * | 3/1974 | Weber | 297/60 |
| 4,211,449 | | 7/1980 | Richardson et al. . | |
| 4,266,822 | | 5/1981 | Barecki et al. . | |
| 4,572,574 | | 2/1986 | Fischhaber et al. . | |
| 4,615,559 | | 10/1986 | Blondeau . | |
| 4,955,973 | | 9/1990 | Provencher . | |
| 5,018,785 | | 5/1991 | Monson et al. . | |
| 5,320,411 | | 6/1994 | Sera . | |
| 5,529,378 | | 6/1996 | Chaban et al. . | |

* cited by examiner

*Primary Examiner*—Peter M. Cuomo
*Assistant Examiner*—Joseph Edell
(74) *Attorney, Agent, or Firm*—Steven Horowitz

(57) ABSTRACT

A foldable park bench that prevents unwanted individuals and animals from sleeping or sitting thereon has wooden seat and wooden seat back. Two parallel vertical metal bars attach to and traverse the rear of the seat back near each end of the bench and are secured to the ground by a single piece of concrete. Each of two hinged horizontal metal bars under the seat that connect to their corresponding vertical bars rest on an L-shaped angle bar that connect to each vertical bar also. The horizontal bars are bisected into a front and rear portion with the rear portion generally corresponding to the part of the horizontal bar not covered by the wooden seat. The hinged bars rotate upward to a folded position along with the seat when the seat is lifted up. A cantilevered chain extends from each vertical bar to the horizontal bar under the seat to provide the seat with further support. When the bench is in folded position, a security chain extending from the rear of a vertical bar attaches to a short extension chain affixed to one of the horizontal bars. A safety bolt prevents children from lifting the seat when the seat is in down position.

7 Claims, 5 Drawing Sheets

FOLDABLE PARK BENCH

BACKGROUND OF THE INVENTION

The present invention relates to benches and more particularly to foldable benches.

The problem of homeless people sleeping on park benches is well known. Similarly, it is preferable if benches would not be used during the night by individuals who are likely to be involved in illegal or undesirable activities. This makes public places such as parks dangerous since it attracts such people to a dark area. Similarly, owners of private gardens certainly would like to prevent intruders from making use of benches located therein. The objective in both cases is to have a simple means of making the bench unusable at the will of the owners and to have that position of the bench securable.

Another problem is that benches can be unable to withstand a load. It is desirable to have an second support means besides the primary support for the seat. The present invention fulfills these needs and provides more.

Foldable seats are known. Foldable table/bench combinations are also known. What is needed is a foldable bench that can be

OBJECTIVES AND ADVANTAGES

The following important objects and advantages of the present invention are:

(A) to provide a bench having a seat that can be folded up alongside the seat back so that the bench cannot be used by people or animals to sleep or sit on, (B) to provide a bench that has a wooden seat and seat back and two parallel metal vertical bars that attach to and perpendicularly traverse a rear of the seat back, and that has hinged horizontal bars that the seat rests on and is affixed to, wherein the hinged horizontal bars meet the vertical bars and the hinge is on a top of the horizontal bar so that the seat can rotate to a vertical up position alongside the seat back, L-shaped angle bars, each angle bar affixed to a vertical bar and to a horizontal bar at a point of connection between the vertical and horizontal bar, said hinged horizontal bars resting on the angle bars for support, (C) to provide a bench that has cantilevered chains extending from each vertical bar to a horizontal bar for further support of the seat, (D) to provide a safe and secure foldable bench having means to prevent children from tampering with the bench when the seat is down and (E) to provide a bench that has a security chain extending from a rear of a vertical bar attaches by means of a lock including a looped portion to a short extension chain when the bench is in folded position, the extension chain attached to a horizontal bar, to prevent the bench seat from being lowered to the down position and being used.

DETAILED DESCRIPTION OF THE PREFERRED EMBODIMENT

Figure 1:
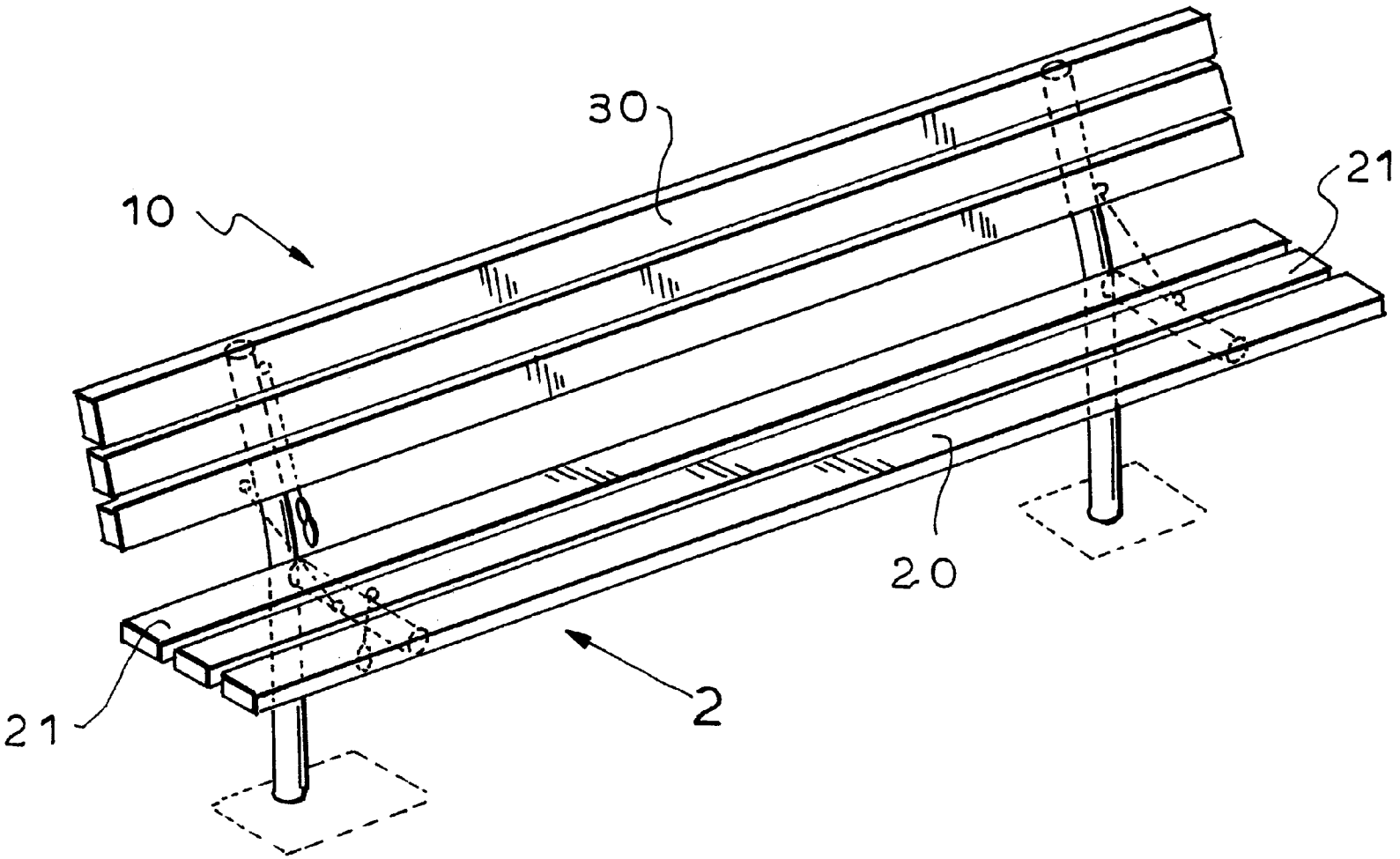
FIG. 1 is a perspective view of the bench of the present invention from the front with the seat down.
Figure 2:
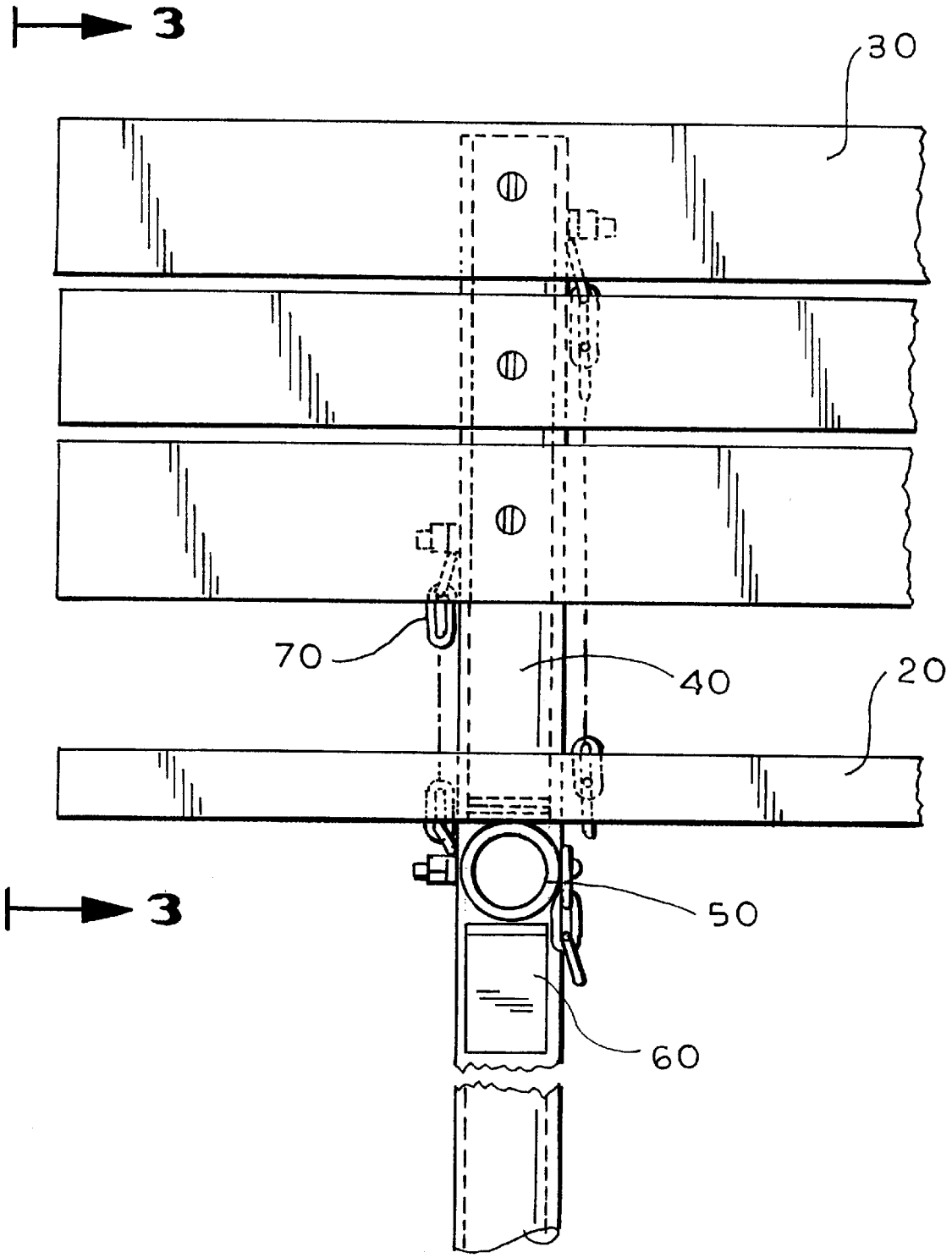
FIG. 2 is an enlarged front view of the left end of the bench of the present invention looking in the direction of the arrow 2 in FIG. 1.

The apparatus will now be illustrated by reference to the accompanying drawings. The bench itself has been assigned reference numeral 10 and its elements have been assigned the reference numerals referred to below.

The present invention is a bench 10 for parks and other open areas such as a private garden. Bench 10 is foldable into a position in which sleeping on it is impossible. This is designed to prevent unwanted individuals from sleeping thereon. By preventing people from being able to sleep on the benches in the park or other open area the park or other public area becomes safer since dark areas open to people to sleep are havens for illegal drugs or other illegal activities and because these areas would attract individuals who are homeless.

Bench 10 includes a wooden seat 20, a wooden seat back 30, two parallel metal vertical bars 40 that attach to and traverse a rear 32 of the seat back 30 perpendicularly and bench 10 includes hinged horizontal bars 50 traversing perpendicularly a bottom 52 of seat 20. Horizontal bars 50 are rotatable due to the hinge 51 from a down position where seat 20 is down for sitting to an up or folded position where seat 20 is folded up next to seat back 30 and no one can sit or sleep on bench 10. Each of the vertical bars 40 are on or near opposite sides of bench 10.

Seat 20 rests on and is affixed to horizontal bars 50 except for an uncovered portion of bars 50. The horizontal bars 50 include typically one bar 50 on each end 21 or near each end 21 of seat 20 and bars 50 meet vertical bars 40. Horizontal bars 50 rest on angle bars 60 for support. Angle bars 60 are L-shaped and are welded and/or bolted to vertical bars 40 and horizontal bars 50. Each angle bar 60 is affixed to a vertical bar 40 and to the corresponding horizontal bar 50 at the point of connection between the vertical bar 40 and the horizontal bar 50. The hinge 51 is located on a top 52 of the horizontal bar 50 and this allows seat 20 to rotate to a vertical up position alongside the seat back 30.

Horizontal bars 50 have an empty or uncovered portion 55 from their point of connection with vertical bars 40 until the point where the planks of seat 20 rest on and cover horizontal bar 50. Given that wooden seat 20 is inelastic, hinge 51 should be situated along uncovered portion 55 of horizontal bars 50 so that bar 50 is rotatable at the point of hinge 51. At the location of hinge 51, each horizontal bar 50 is cut perpendicularly to the length of the bar 50 and thereby separates into a front portion **50*b* and a rear portion 50*a*. The rear portion 50*a* of horizontal bars 50 is the portion that projects from vertical bars 40 and typically forms most of uncovered portion 55. The front portion 50*b* of horizontal bars 50 is entirely or mostly under seat 20 and is affixed to seat 20 by well known means such as bolts. The only point of connection between the front portion 50*b* and the rear portions 50*a* of horizontal bars 50 at the point of separation between them is at hinge 51 and this allows for the rotation upward of the rear portion 50*b* of horizontal bar 50 and of seat 20 by means of hinge 51 when seat 20** is lifted to folded position.

In the preferred embodiment horizontal bars 50 are hollow cylinders but they need not be.

An important feature of the present invention is that seat 20 folds up rather than having seat back 30 fold down. If seat back 30 folded down, however, the bench would not achieve its objectives since the bench would still be usable in its folded position since people would still be able to sit or lie on the top of the seat back.

Cantilevered chains 70 extend from each vertical bar 40 to its corresponding horizontal bar 50 for further support. Cantilevered chains 70 are taut so that if the angle bar 60 were to fail the cantilevered chains 70 would hold seat 20 although the seat 20, in such an event, would be urged upward toward seat back 30 slightly.

A security chain 80 is provided for locking the bench 10 into folded position so it cannot be tampered with. Security chain 80 extends from a rear 42 of a vertical bar 40 on either side of the bench 10 and attaches by means of a lock 90 of the kind that has a looped portion 91. Looped portion 91 of lock 90 extends through one of the last links of security chain 80 and through a short extension chain 88 that attaches to horizontal bar 50. This occurs when bench 10 is in folded position.

Typically, although not necessarily, wooden seat 20 is comprised of three wooden planks and wooden seat back 30 is similarly comprised of three wooden planks.

Another feature of the bench 10 is that it is designed to be firmly rooted in the ground of the park area notwithstanding the fact that only single discrete vertical bars 40 attach to the ground. In the prior art benches, the vertical frame has legs that have fingers that can be bolted to the ground. Bench 10 has vertical bars 40 that are affixed to a concrete slab (not shown) under the ground. The horizontal top surface area of the concrete slab is large enough to prevent the uprooting the vertical bars or the bench 10 from the ground.

Figure 3:
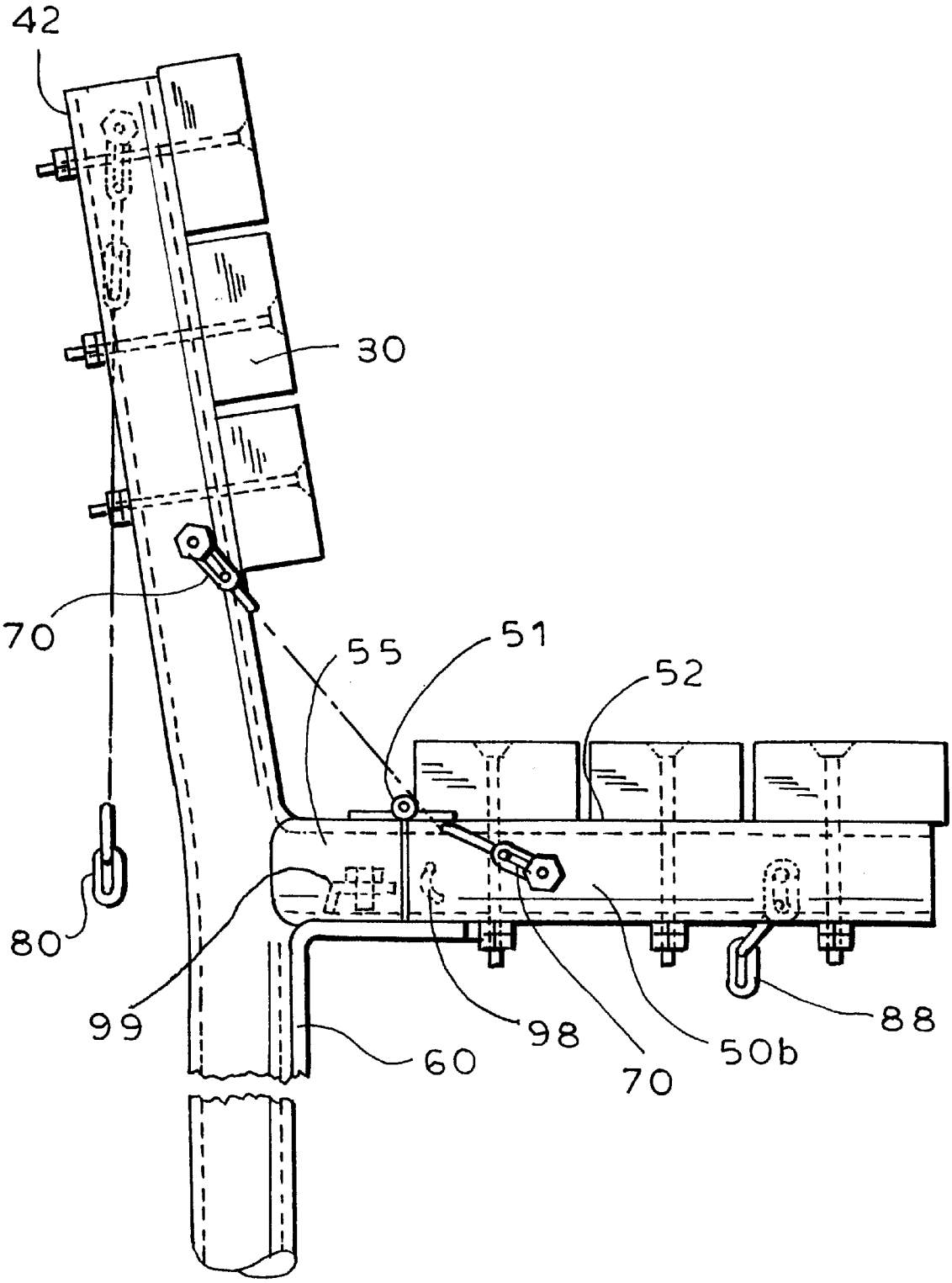
FIG. 3 is a side view of FIG. 2 taken from the view of line 3—3 of FIG. 2
Figure 4:
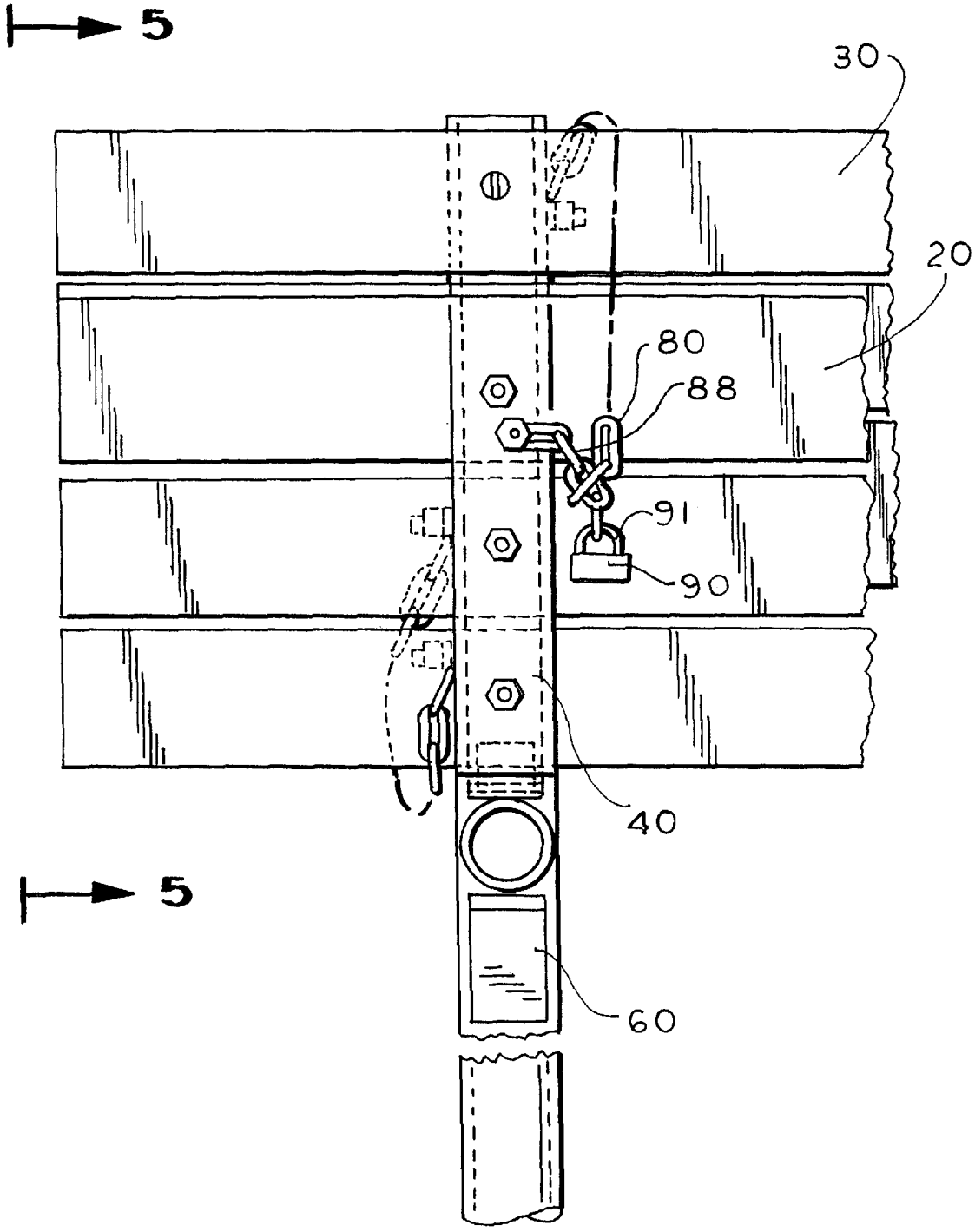
FIG. 4 is an enlarged front view of the bench of the present invention in folded position and secured.
Figure 5:
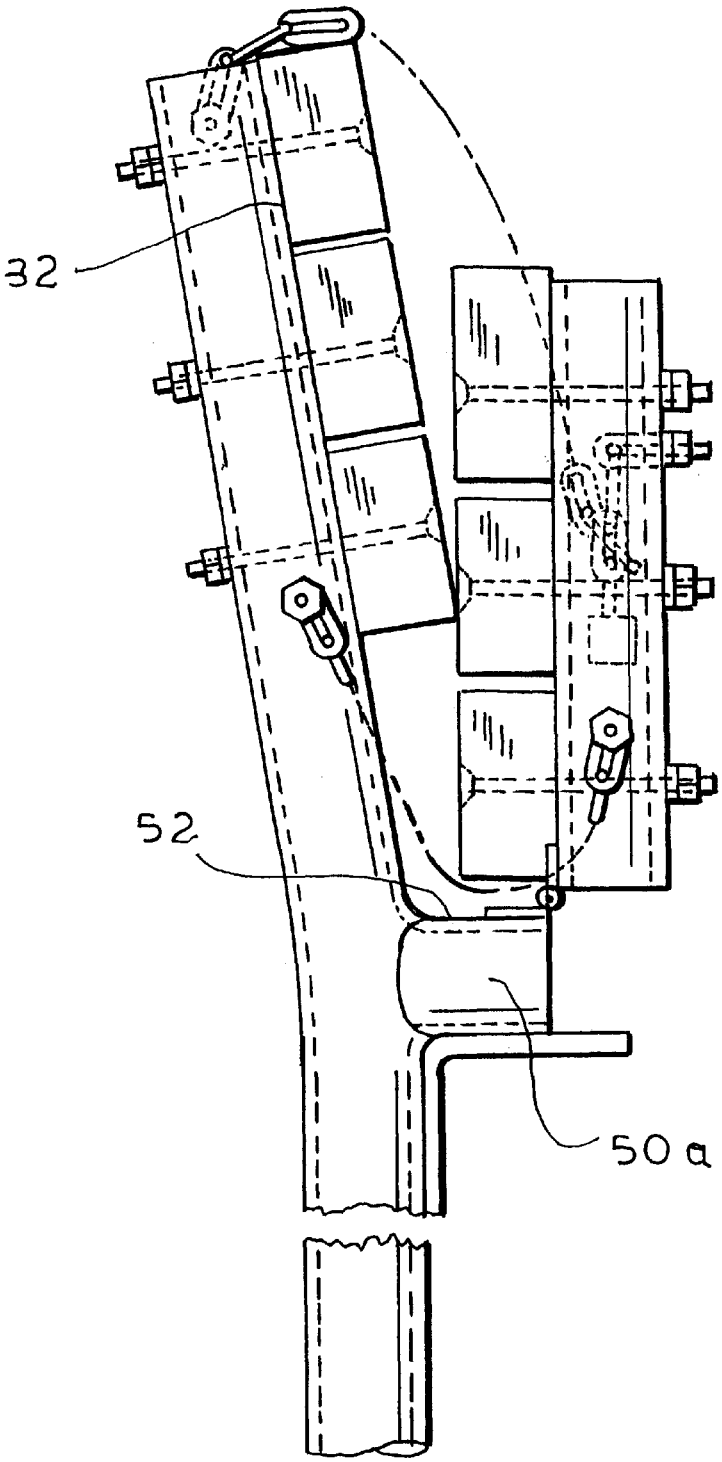
FIG. 5 is a side view of FIG. 4 taken from the view of line 5—5 of FIG. 4.

As seen in FIG. 3, a safety bolt 99 provides further security for when the seat 20 is down so that children cannot lift seat 20 up and catch their fingers in the area of the hinge 51. Safety bolt 99 is affixed through well known means to rear portion 55*a* and slides from rear portion 50*a* at uncovered portion 55 of one (or both) of horizontal bars 50 to a loop 98 or receiving element 98 affixed to front portion 50*b* of the same (one or both) horizontal bar(s) 50.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A foldable bench for parks and other open areas, comprising:

a wooden seat, a wooden seat back, two parallel metal vertical bars that attach to and perpendicularly traverse a rear of the seat back, hinged horizontal bars meeting the vertical bars, said seat resting on and being affixed to all of the horizontal bars except for an uncovered portion of the horizontal bars, each horizontal bar being cut into a front portion and a rear portion, said front and rear portions being in connection with one another only by a hinge located on a top of the horizontal bar that affords the front horizontal bar and the seat the ability to rotate to a vertical up position alongside the seat back, L-shaped angle bars, each angle bar affixed to a vertical bar and to a horizontal bar at a point of connection between the vertical and horizontal bar, said hinged horizontal bars resting on the angle bars for support, cantilevered chains extending from each vertical bar to a horizontal bar for further support of the seat and a security chain extending from a rear of a vertical bar attaches by means of a lock including a looped portion to a short extension chain when the bench is in folded position, said extension chain attached to a horizontal bar.

2. The bench of claim 1, wherein the wooden seat is comprised of three planks and the wooden seat is comprised of three planks.

3. The bench of claim 1, wherein said vertical bars are affixed to a concrete slab under the ground whose horizontal top surface area is large enough to prevent uprooting the vertical bars from the ground.

4. The bench of claim 1, wherein the seat can be maintained securely in a down position by a safety bolt affixed to the rear portion of a horizontal bar and attachable to a receiving element affixed to the front portion of the same horizontal bar.

5. The bench of claim 1, wherein the wooden seat is comprised of three planks and the wooden seat is comprised of three planks and wherein said vertical bars are affixed to a concrete slab under the ground whose horizontal top surface area is large enough to prevent uprooting the vertical bars from the ground.

6. The bench of claim 1, wherein the wooden seat is comprised of three planks and the wooden seat is comprised of three planks, wherein said vertical bars are affixed to a concrete slab under the ground whose horizontal top surface area is large enough to prevent uprooting the vertical bars from the ground and wherein the seat can be maintained securely in a down position by a safety bolt affixed to the rear portion of a horizontal bar and attachable to a receiving element affixed to the front portion of the same horizontal bar.

7. The bench of claim 1, wherein each of the vertical bars are near an opposite side of the bench.

* * * * *